US005150687A

United States Patent [19]

Paganon et al.

[11] Patent Number: 5,150,687

[45] Date of Patent: Sep. 29, 1992

[54] SUPPLY CIRCUIT FOR OPERATION OF AN ELECTROMAGNETIC LOAD

[75] Inventors: Henri Paganon, Venissieux; Guy Pichon, Roussillon, both of France

[73] Assignee: Robert Bosch GmbH, Stuttgart, Fed. Rep. of Germany

[21] Appl. No.: 768,916

[22] PCT Filed: May 30, 1990

[86] PCT No.: PCT/DE90/00405

§ 371 Date: Oct. 2, 1991

§ 102(e) Date: Oct. 2, 1991

[87] PCT Pub. No.: WO91/00421

PCT Pub. Date: Jan. 10, 1991

[30] Foreign Application Priority Data

Jun. 29, 1989 [DE] Fed. Rep. of Germany ..... 3921308

[51] Int. Cl.[5] ..... F02D 41/20

[52] U.S. Cl. ..... 123/490; 361/154

[58] Field of Search ..... 123/490; 361/152, 154

[56] References Cited

U.S. PATENT DOCUMENTS 4,417,201 11/1983 Reddy ..... 361/154 X
4,774,624 9/1988 Quanlich ..... 123/490 X
4,884,160 11/1989 Pasquarella ..... 361/154 X
4,925,156 5/1990 Stoll et al. ..... 123/490 X
4,949,215 8/1990 Studtmann et al. ..... 361/154
4,950,974 8/1990 Pagano ..... 123/490 X

FOREIGN PATENT DOCUMENTS

0306839A1 3/1989 European Pat. Off. .
3511966A1 10/1986 Fed. Rep. of Germany .
2569239 2/1986 France .
58-074874 5/1983 Japan .
59-153979 9/1984 Japan .

*Primary Examiner*—Willis R. Wolfe
*Attorney, Agent, or Firm*—Kenyon & Kenyon

[57] ABSTRACT

A supply circuit is provided for operation of an electromagnetic load of a vehicle provided with generator (dynamo) and battery, and more particularly for operation of at least one solenoid valve of a fuel-injection system of an internal-combustion engine of the vehicle. A circuit arrangement is proposed which connects the load (6) for a buildup of its excitation to the generator (3) and then establishes a connection to the battery (13) for the maintenance of sufficient excitation and interrupts the connection to the generator (3).

18 Claims, 5 Drawing Sheets b)

c)

Fig. 5
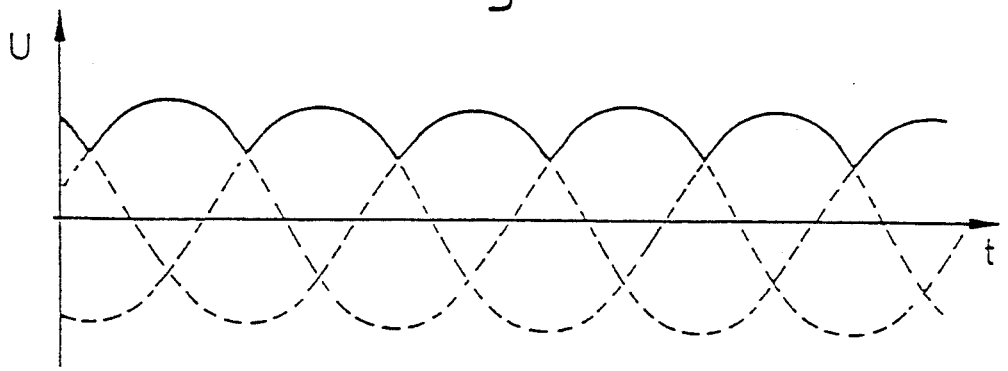
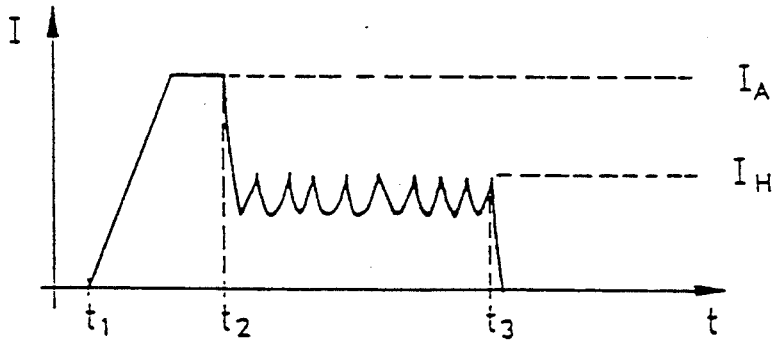
Fig. 6

SUPPLY CIRCUIT FOR OPERATION OF AN ELECTROMAGNETIC LOAD

FIELD OF THE INVENTION

The present invention relates to a supply circuit for operation of an electromagnetic load of a vehicle provided with a generator (dynamo) and battery, and more particularly, for operation of at least one solenoid valve of a fuel-injection system of an internal-combustion engine of the vehicle.

BACKGROUND OF THE INVENTION

When an electromagnetic load is switched on, the load current does not increase suddenly; rather, it rises relatively slowly. As a result, the load comes up to its rating only with a certain time delay after the turn-on time. This peculiarity is a drawback in many technical devices.

In the case of electromagnetic injection valves of an internal-combustion engine of a vehicle, this turn-on time delay is responsible for the fact that the fuel injection time cannot be determined with sufficient accuracy. To overcome this drawback, it is known to generate the control pulse for the solenoid valve in such a way that a relatively high current surge (pull-in current) is present which leads to very rapid actuation of the solenoid valve, and which is followed by a lower, steady-state current value (hold current) for maintaining the solenoid valve in its operated position. Electronic circuits of great complexity are required for the generation of such control pulses. (German published patent application 28 28 678.)

SUMMARY OF THE INVENTION

The supply circuit of the present invention offers the advantage of providing, through relatively simple means for building up the excitation of the electromagnetic load, in other words, for the pull-in phase of the solenoid valve, a sufficiently large current for the solenoid valve to be actuated reliably and within a minimum of time. Once this state has been attained, a changeover to a considerably lower energy input occurs, that is, the load current is reduced to the hold current of the solenoid valve. For the implementation of the operation just described, the invention utilizes means already in place in the vehicle. These are the generator (dynamo) and the battery.

Since the generator charges the battery while the internal-combustion engine is in operation, its terminal voltage is made larger than that of the battery. The invention takes advantage of this by providing a circuit arrangement which connects the load (i.e., the solenoid valve) for a buildup of its excitation, in other words, for the pull-in phase, to the generator, so that it is supplied with a relatively high voltage resulting in rapid excitation. If in the exemplary embodiment here considered the solenoid valve is the load, then it is actuated within a very short time. Once this state has been attained, that is, when the load is in its desired state of excitation, the circuit arrangement effects, in accordance with the invention, such a changeover that a connection to the battery is established to maintain sufficient excitation and the connection to the generator is interrupted. The excitation is preferably reduced to a value which, though relatively low, is sufficient to maintain the valve in its operated position. The pull-in current flowing initially can consequently be reduced to the hold current.

As a further feature, the invention provides for a voltage booster to be located between generator and load. This makes it possible to send in a relatively short time a very large current through the excitation coil of the solenoid valve. With an inductance of 170 millihenrys, for example, the pull-in current pulse is preferably of the order of magnitude of 70 amperes. A voltage of the order of about 100 volts is thus required. The voltage booster consequently must raise the vehicle electrical system voltage, which usually is between 12 and 14 volts, to that voltage level.

In a preferred embodiment of the invention, the voltage booster is designed as a transformer. The generator is preferably an alternating-current generator; a three-phase generator, in particular, may be used.

A rectifier may be connected between generator and load. This rectifier may be located in particular between the transformer which forms the voltage booster and the solenoid valve. In the case of a three-phase generator, the three-phase alternating voltage produced is thus first transformed and then rectified. The three-phase arrangement has the advantage that the rectified direct voltage has a relatively low ripple.

To be able to provide sufficient energy for the pull-in phase of the solenoid valve, an energy-storage device may be used. The latter may be connected, in particular, following the rectifier and may be in the form of a capacitor.

The changeover from the described pull-in operating mode to the hold mode is performed by means of controllable switching devices of the circuit arrangement. Preferably, one switching device is connected to the generator, and another to the battery. These two switching devices pass the load current to the load by way of diodes connected in the forward direction. These diodes decouple the two energy sources (generator or energy-storage device and battery) from each other.

BRIEF DESCRIPTION OF THE DRAWINGS

FIG. 5 is a diagram of a rectified generator voltage; and

FIG. 6 is a current-time diagram of a solenoid valve.

DETAILED DESCRIPTION

Figure 1:
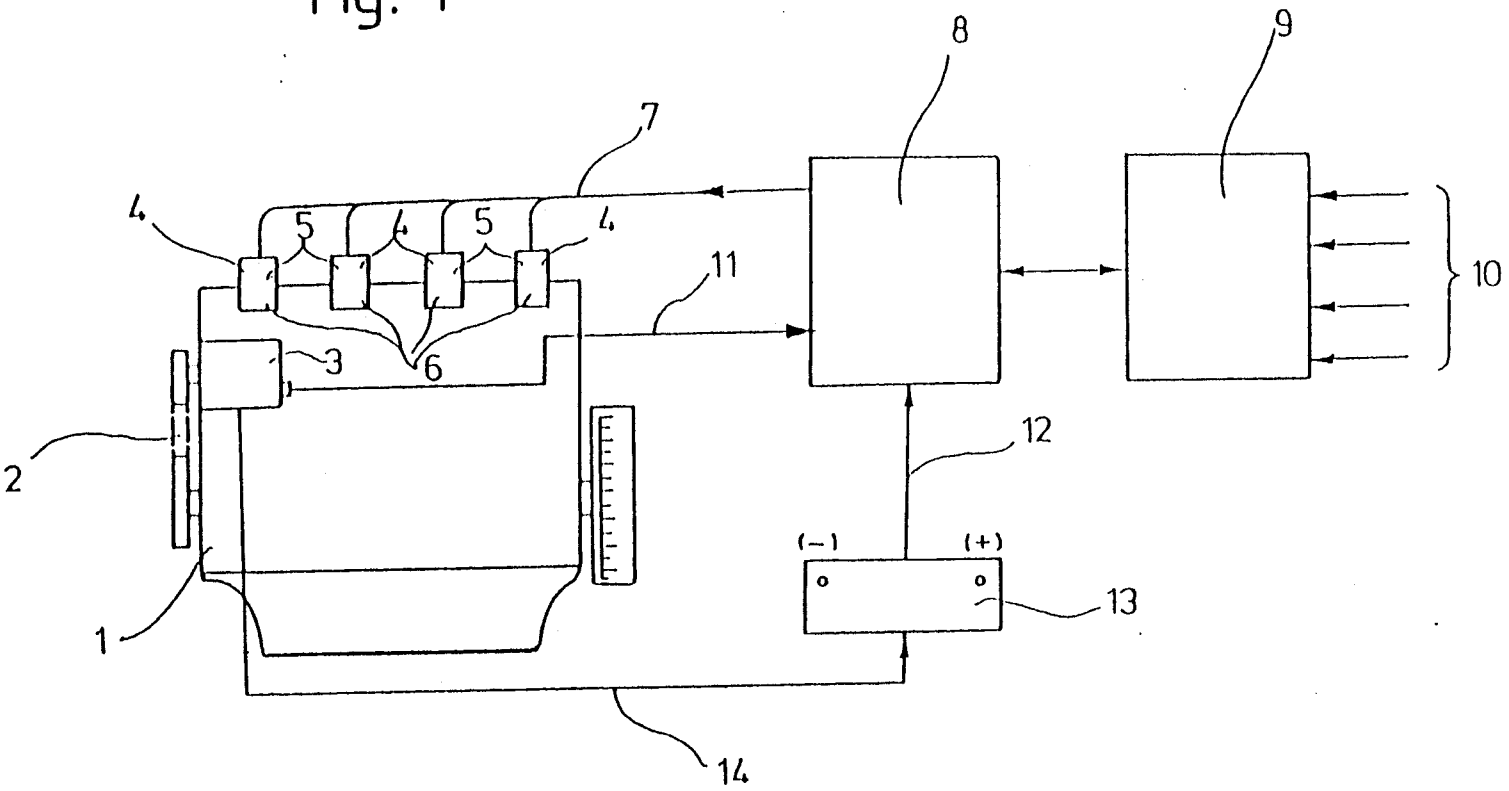
FIG. 1 is a block diagram of an electrical system of a motor vehicle.

FIG. 1 shows an internal-combustion engine 1 of a vehicle (not shown). The internal-combustion engine 1 is connected through a V-belt arrangement 2 with a generator (dynamo) 3 designed as a three-phase generator. The internal-combustion engine 1 has four cylinders. Consequently, four injection valves 4 are provided. These are designed as solenoid valves 5 and therefore represent electromagnetic loads 6.

The solenoid valves are connected through lines 7 to a controller 8 which cooperates with a computer 9. The latter has inputs 10 to which the information necessary for determination of injection time, injection quantity and injection duration is routed.

The controller 8 is connected through a line 11 to the generator 3 and through a line 12 to a battery 13 of the vehicle. There is, moreover, a connection 14 between the generator 3 and the battery 13. The connection 14 assures the recharging of the battery 13.

Figure 2:
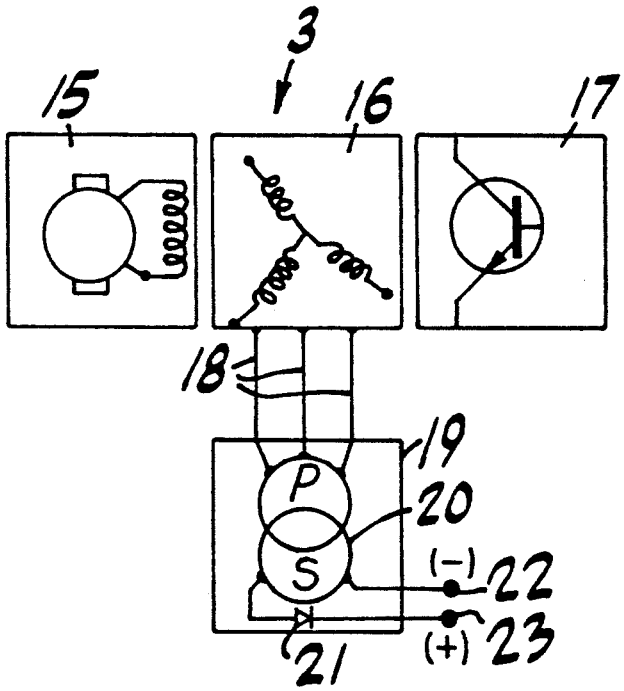
FIG. 2 is a block diagram of a generator and a voltage booster.

FIG. 2 shows diagrammatically in detail the makeup of the generator 3. The latter comprises a rotor 15 and a stator 16 as well as a controller 17 of the electronic type, which is indicated in the drawing by the symbol for a transistor. The stator 16 is connected through lines 18 to a voltage booster 19 in the form of a transformer 20. While the primary winding P of the transformer 20 is connected to the stator 16 of the generator 3, its secondary winding S is connected to a rectifier 21. The rectified transformer voltage is available at terminals 22 and 23.

Figure 3:
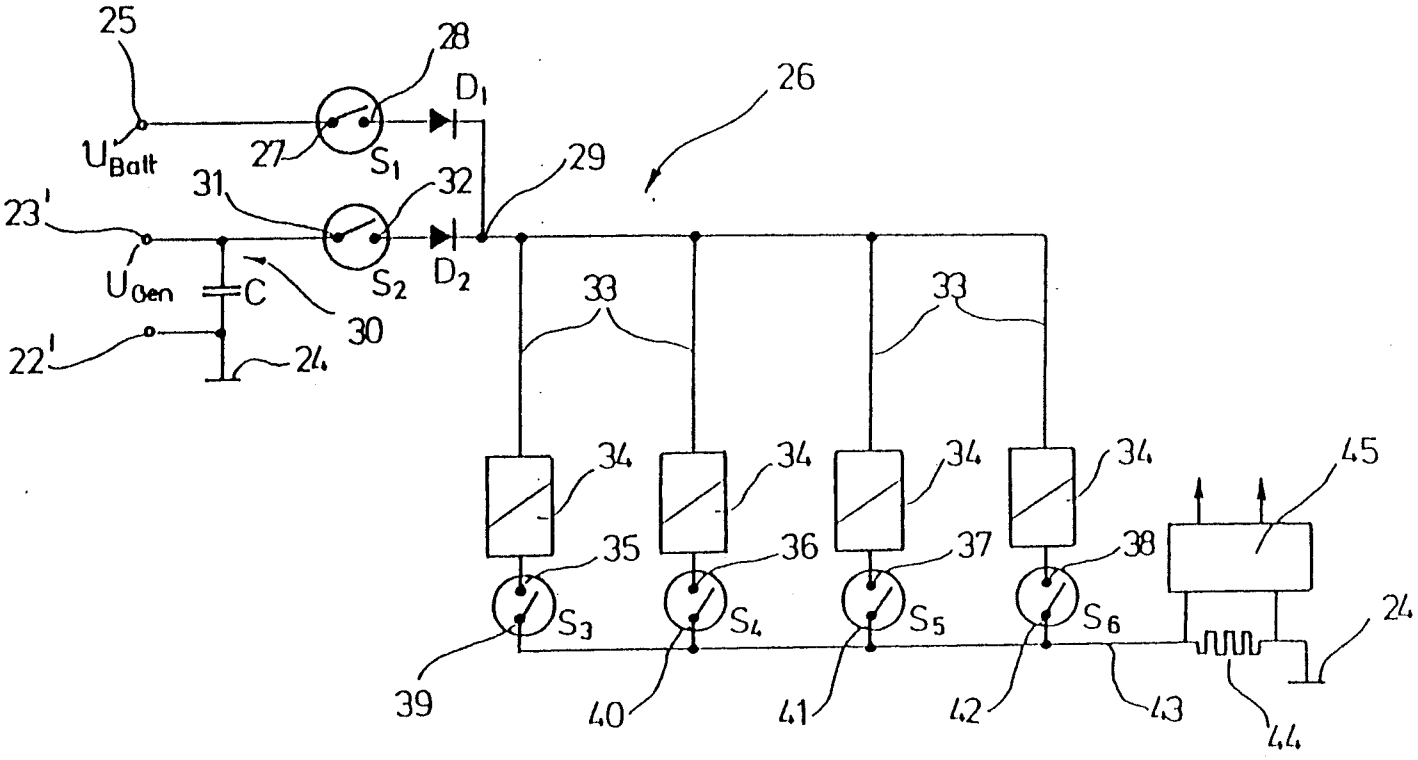
FIG. 3 shows a circuit arrangement which is connected to the system of FIG. 2 and supplies a plurality of solenoid valves of a fuel injection system of an internal-combustion engine of the vehicle.

The terminals 22 and 23 of FIG. 2 are connected to corresponding terminals 22' and 23' of FIG. 3. Terminal 22' is grounded at 24, that is, connected to the chassis of the vehicle. The negative pole of the battery 13 is also grounded at 24. The positive pole of the battery 13 is connected to a terminal 25. Consequently, the battery voltage $U_{Batt}$ is present between terminal 25 and ground 24, and the generator voltage $U_{Gen}$, stepped up by the transformer 20 and rectified by the rectifier 21, between terminal 23 or 23', respectively, and ground 24.

The terminals 22', 23' and 25 are part of a circuit arrangement 26 which comprises controllable switching devices S1, S2, S3, S4, S5 and S6. The switching devices S1 to S6 can be placed in their ON or OFF state by means of a control device (not shown in detail) of the circuit arrangement 26 or by means of the controller 8.

While one terminal 27 of the switching device S1 is connected to terminal 25, its other terminal 28 is connected to the anode of a diode D1. The cathode of diode D1 is connected to a tie point 29.

Inserted between the terminals 22' and 23' is a capacitor C which forms an energy-storage device 30. Terminal 23' is further connected to one terminal 31 of the switching device S2. The other terminal, 32, of switching device S2 is connected to the anode of a diode D2 whose cathode is connected to the tie point 29. Through lines 33, which include line 7 of FIG. 1, the tie point 29 is connected to one lead of each excitation coil 34 of the solenoid valves 5. The other leads of the excitation coils 34 are connected to terminals 35, 36, 37 and 38 of the switching devices S3, S4, S5 and S6. The other terminals 39, 40, 41 and 42 of the switching devices S3, S4, S5 and S6 are connected to a bus line 43 which, through a precision resistor 44, is connected to ground at 24. Connected in parallel with the precision resistor 44 is a current regulator 45 which cooperates with devices of the controller 8 to provide for an optimal current supply to the solenoid valves 5.

Figure 4A:
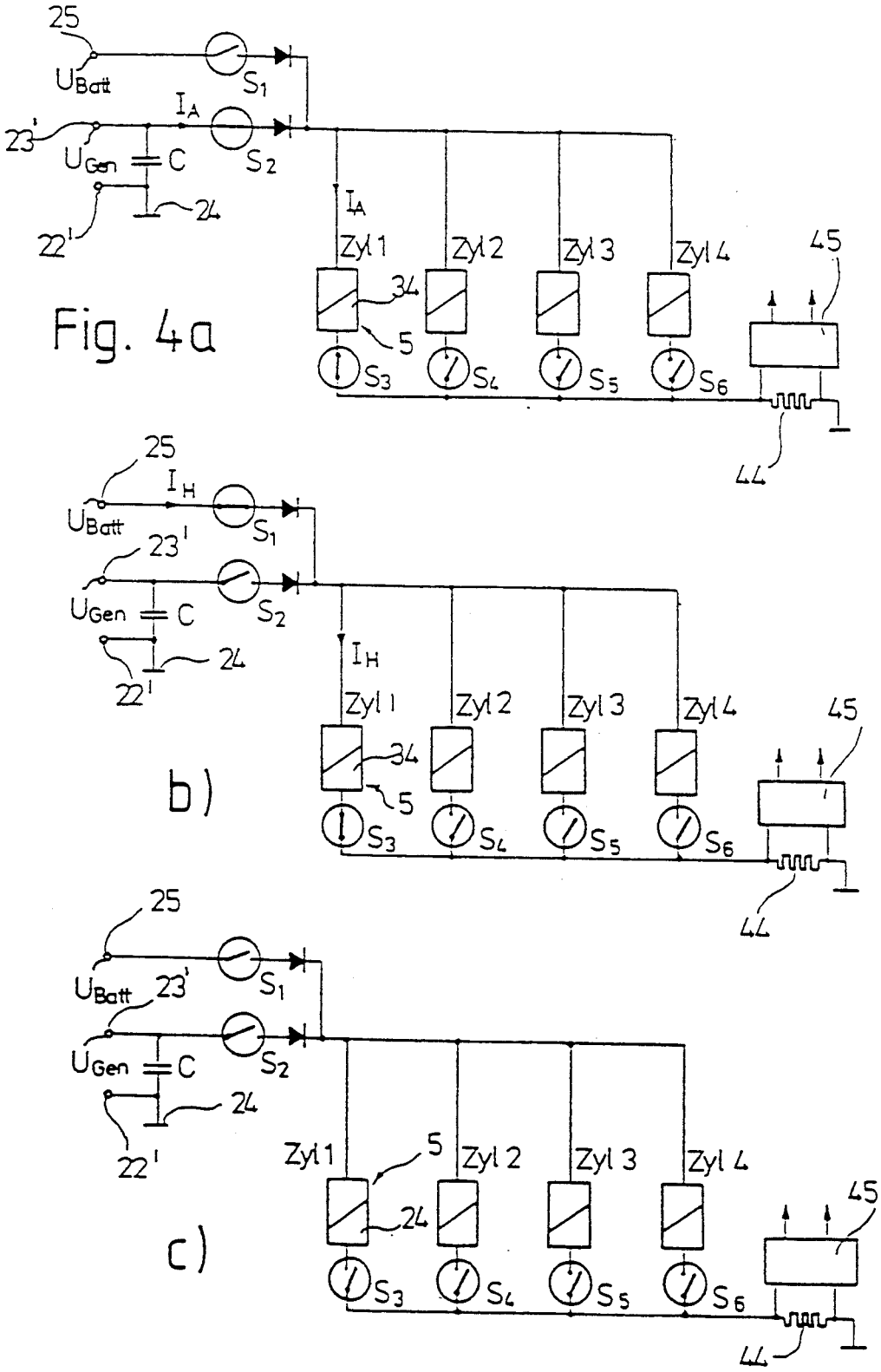
FIG. 4 (*a*) to (*c*) shows the circuit arrangement of FIG. 3 in various switching states.

The supply circuit in accordance with the invention, shown in FIGS. 2 and 3, for the solenoid valves 5 operates as follows:

Suppose that the controller 8 seeks to perform an injection of fuel into the first cylinder Zyl1 of the internal-combustion engine 1 (FIG. 4*a*). The first cylinder Zyl1 is assigned to switching device S3 while the second cylinder Zyl2 cooperates with switching device S4, the third cylinder Zyl3 with switching device S5, and the fourth cylinder Zyl4 with switching device S6. For the operation of the first cylinder Zyl1, the controller 8 drives the switching devices S2 and S3 into their closed states so that a pull-in current $I_A$, driven by the generator voltage $U_{Gen}$, flows through the excitation coil 34 of solenoid valve 5, assigned to the first cylinder Zyl1. As a result of the voltage boost by the transformer 20, the generator voltage $U_{Gen}$ may have a relatively high value. Besides, in addition to the direct energization by the generator 3 there is the energy stored in the capacitor C. Overall, a strong and rapidly rising pulse of pull-in current $I_A$ is thus generated, as is apparent from FIG. 6. The time $t_1$ there signifies the switching on of the excitation coil of solenoid valve 5 of cylinder Zyl1. At time $t_2$ (FIG. 6), switching device S2 of the circuit arrangement 26 is reset into its open position (FIG. 4*b*), and switching device S1 is simultaneously set to its closed position. As a result, the excitation coil 34 of solenoid valve 5 of the first cylinder Zyl1 is disconnected from the generator voltage $U_{Gen}$ and at the same time connected to the battery voltage $U_{Batt}$. Since the battery voltage $U_{Batt}$ is smaller than the generator voltage $U_{Gen}$, as mentioned earlier, the current flowing through the excitation coil 34 drops, decreasing to a hold current $I_H$ that is sufficient for maintaining the solenoid valve in its operated position. The drop in the current is clearly apparent from FIG. 6: From time $t_2$, the current through the excitation coil decreases to the hold current $I_H$.

At time $t_3$ (FIG. 6), the switching devices S1 and S3 (see FIG. 4*c*) open, with the current then dropping to a value of 0.

The energization of the other excitation coils 34 of the solenoid valves 5 associated with the cylinders Zyl2, Zyl3 and Zyl4 is effected in the same manner.

It is apparent from the foregoing that the buildup of the excitation of the excitation coil 34 of the appropriate solenoid valve 5 is brought about directly by the energy supplied by the generator 3, "directly" allowing for the use of a voltage booster and of a rectifier. For the maintenance of sufficient excitation to hold the solenoid valve 5 in its operated position, the energy supplied by the battery 13 is used.

FIG. 5 shows that the voltage supplied by the three-phase generator, stepped up by the transformer 20 and rectified by the rectifier 21, has a relatively low ripple, as pointed out earlier.

We claim:

1. A supply circuit for operation of an electromagnetic load of a vehicle having a generator and battery, and a load including at least one solenoid valve of a fuel-injection system of an internal-combustion engine of the vehicle, comprising:

a circuit arrangement which connects the load to the generator for a buildup of excitation of the load, and then establishes a connection of the load to the battery and interrupts the connection of the load to the generator for the maintenance of sufficient excitation of the load.

2. A supply circuit as defined in claim 1, further comprising the voltage booster coupled between the generator and load.

3. A supply circuit as defined in claim 2, wherein the voltage booster includes a transformer.

4. A supply circuit as defined in claim 1, wherein the generator is an alternating-current generator.

5. A supply circuit as defined in claim 1, wherein the generator is a three-phase generator.

6. A supply circuit as defined in claim 1, further comprising a rectifier connected between the generator and load.

7. A supply circuit as defined in claim 1, further comprising an energy-storage device coupled to the rectifier.

8. A supply circuit as defined in claim 7, wherein the energy-storage device includes a capacitor.

9. A supply circuit as defined in claim 1, further comprising two controllable switching devices, one of the switching devices being connected to the generator, the other switching device being connected to the battery, and both switching devices being connected to the load through corresponding diodes for controlling current flow to the load.

10. A supply circuit for operating a plurality of injection valves of a fuel-injection system of an internal-combustion engine, comprising:

a generator selectively coupled to the injection valve for positioning the injection valves in an operating state; and a battery selectively coupled to the injection valves for maintaining the injection valves in the operating state.

11. A supply circuit as recited in claim 10, further comprising a transformer, wherein the input of the transformer is coupled to the generator, and the output of the transformer is coupled to the injection valves.

12. A supply circuit as recited in claim 11, further comprising a rectifier coupled to the output of the transformer.

13. A supply circuit as recited in claim 12, further comprising an energy-storage device coupled between the output of the rectifier and ground.

14. A supply circuit as recited in claim 13, wherein the energy-storage device includes a capacitor.

15. A supply circuit as recited in claim 13, further comprising two controllable switching devices for selectively coupling the generator and battery, respectively, to the injection valves.

16. A supply circuit as recited in claim 15, further comprising a current regulator and a resistor coupled in parallel and selectively coupled to the injection valves.

17. A supply circuit as recited in claim 16, wherein the generator is an alternating-current generator.

18. A supply circuit as recited in claim 16, wherein the generator is a three-phase generator.

* * * * *